US005314546A

United States Patent [19]

Melzer et al.

[11] Patent Number: 5,314,546

[45] Date of Patent: May 24, 1994

[54] PROCESS FOR ENHANCED DRAINAGE OF RESIDUAL AQUEOUS RINSE ON THE EXTERNAL SURFACE OF PLASTIC PARTS

[75] Inventors: Jeffrey I. Melzer, Lansdale; Barry P. Gunagan, Hatboro, both of Pa.

[73] Assignee: Betz Laboratories, Inc., Trevose, Pa.

[21] Appl. No.: 435

[22] Filed: Jan. 4, 1993

[51] Int. Cl.[5] ..... B08B 7/00

[52] U.S. Cl. ..... 134/42

[58] Field of Search ..... 134/42

[56] References Cited

U.S. PATENT DOCUMENTS 4,650,526 3/1987 Claffey et al. ..... 148/6.14 R 5,026,440 6/1991 Finnenthal et al. ..... 148/247

5,053,081 10/1991 Jacob ..... 106/287.11

*Primary Examiner*—R. Bruce Breneman

*Assistant Examiner*—Zeinab El-Arini

*Attorney, Agent, or Firm*—Alexander D. Ricci; Philip H. Von Neida

[57] ABSTRACT

Processes for enhancing the drainage of residual aqueous rinse from the external surfaces of plastic parts, such as auto fascia, are disclosed. The processes employ an aqueous solution of a zircoaluminate compound, which when applied to the surfaces of plastic parts will not rinse off during subsequent rinse stages and will remain on the plastic parts.

8 Claims, No Drawings

PROCESS FOR ENHANCED DRAINAGE OF RESIDUAL AQUEOUS RINSE ON THE EXTERNAL SURFACE OF PLASTIC PARTS

FIELD OF THE INVENTION

The present invention relates to processes for rinsing plastic parts. Aqueous solutions of zircoaluminate compounds are effective at enhancing the drainage of residual rinse water from the surfaces of the plastic parts.

BACKGROUND OF THE INVENTION

In the automotive industry, the formed plastic parts (fascia) used are often painted. This is to provide a smooth, oftentimes metal-like finish. The paint covers molding and other substrate imperfections. Decorative effects such as mirror finishes, texturing and color match of differently processed parts are also achieved by painting.

Examples of plastics that are paintable and used in the automotive industry include polycarbonate/polybutylene terephthalate, polyphenyleneoxide/nylon 66, polyphenyleneoxide polybutylene terephthalate, polyether-polyester copolymer/polybutylene terephthalate, polycarbonate (both unfilled and glass filled), polyphenyleneoxide (both unfilled and filled) and a resin/-glass material.

Most plastics need to be cleaned before painting them. The most common contaminants that must be removed before painting are mold release agents, shop soil, material handling soil, machining soils, fingerprints and plastic sanding dust. These contaminants are removed by chemical means such as detergents.

The process of cleaning plastic parts generally entails a wash stage, a rinse stage and a final rinse stage with deionized water. The plastic part can be either spray washed or immersed in the detergent. The most common processes are either an acidic detergent wash stage followed by multiple rinse stages, or an alkaline detergent stage, followed by a rinse stage, an acidic detergent wash stage, and multiple rinse stages. One process, for example, employs in stage 1 an alkaline wash, followed by a tap water rinse in stage 2. Stage 3 is an acidic wash with a tap water rinse in stage 4. Stages 5 and 6 can then be deionized water rinses.

When the plastic part is to be painted, the cleaning operation is performed in a production line with the freshly cleaned part sequentially conveyed into the paint booth. Problems can occur however, when the freshly cleaned part is not fully dry. This can lead to "spotting" when painted and will result in an imperfect paint job. This will require stripping of the part and/or an additional painting procedure.

Further, when a bead of water dries on the plastic surface, ionic salts such as Cl, Ca, Mg and K will remain on the surface of the plastic. After the plastic has been painted, there will be a visual defect there. Exposure to humidity which can cause increased water sensitivity can lead to blistering of the paint. Adhesion problems could also possibly result.

Removing the aqueous rinse water from the surface of the plastic requires a drainage enhancing solution which will effectively aid in drying the plastic part to be painted. The present inventors have discovered an aqueous solution which will aid in reducing spotting on the external surface of plastic parts. More surprisingly, the present inventors have discovered a drainage enhancing solution that will not be rinsed off the surface of the plastic parts by subsequent rinses.

SUMMARY OF THE INVENTION

The present invention provides for processes for enhancing the drainage of residual aqueous rinse from the external surfaces of plastic parts comprising a zircoaluminate compound.

More preferably, the present invention provides for processes for enhancing the drainage of residual aqueous rinse from the external surfaces of plastic parts comprising an aqueous solution of a zircoaluminate compound having the formula

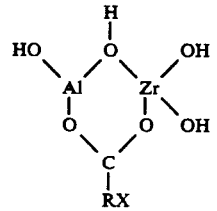

wherein RX can be $NH_2(CH_2)_2$, $(CH_2)_4$ COOH, $(CH_2)_{12}CH_3$, $SH(CH_2)_2$, $CH(NH_2)CH_2OH$ and $(NH_2)CHCH_2SH$.

The improvement in the processes of the present invention is the ability of the drainage enhancing solution to remain on the surface of the plastic parts during subsequent rinse stages.

The present invention effectively reduces the amount of residual water on the external surfaces of the plastic parts prior to their painting. Any water left on the external surfaces can lead to spots and imperfections in the final paint finish. This invention is particularly effective at aiding the drainage of an aqueous rinse from the external surfaces of virgin and rework plastic used in the automotive industry.

DESCRIPTION OF THE RELATED ART

Aluminum zirconium complexes are employed in U.S. Pat. No. 4,650,526, Claffey et al., and used to improve the adhesion of an organic siccative coating to metal surfaces. U.S. Pat. No. 5,053,081, Jacob, teaches a composition and method of using the composition comprising an organosilane compound and an organic titanium chelate. This composition imports improved siccative coating adhesion on metal surfaces. Finnenthal et al., U.S. Pat. No. 5,026,440 teaches processes for treating etched metal surfaces and improved adhesion of a subsequent organic coating using an aqueous solution of an aluminum-zirconium complex and, after rinsing, an organic and/or inorganic film-forming materials.

DETAILED DESCRIPTION OF THE INVENTION

The present invention provides for processes for enhancing the drainage of residual aqueous rinse from the external surfaces of plastic parts comprising contacting an effective amount for the purpose of an aqueous solution of a zircoaluminate compound, wherein said aqueous solution remains on the surfaces of said plastic parts during subsequent rinse stages.

The zircoaluminate compounds have the formula

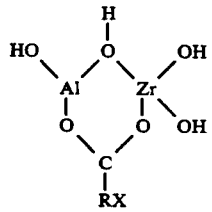

wherein RX can be $NH_2(CH_2)_2$, $(CH_2)_4COOH$, $(CH_2)_{12}CH_3$, $SH(CH_2)_2$, $CH(NH_2)CH_2OH$ and $(NH_2)$ CHCH2SH.

These zircoaluminate compounds are commercially available from Rhone-Poulenc under the Manchem® series. Representative compounds include Manchem® APG-X, F, S, APG-1 and APG-3.

Prior rinse aid technology generally reduced the surface tension of the rinse water to aid the water in sheeting. However, this was a once-through treatment as the rinse aid, too, would be removed from the plastic and would not be available for additional rinses without further addition.

The improvement in the present invention is that the zircoaluminate compounds react with the plastic surface and are not removed when rinsed. This allows the rinse aid to be applied in the earliest rinse stage and will remain effective throughout subsequent rinses. This eliminates the necessity of applying the rinse aid in each rinse stage.

The advantages of having the zircoaluminate compounds react with the plastic are fourfold. The drainage enhancing agent can be added in the rinse directly after the acid wash. There will be a reduction in carryover or drag-in of ionic salts as the plastic part moves through the process. Water sensitivity of painted parts will be lessened as fewer and fewer ionic salts remain on the plastic. If the rinse aid is added early in the process, there is potential for reduced rinse water use in later stages. Contamination of later rinse water stages will be reduced, thereby lessening the amount of makeup water needed.

The zircoaluminate compounds are preferably added to the plastic surface in an aqueous solution, preferably in deioinized water. Other compatible solvents may also be utilized. The zircoaluminate compound may be added to the aqueous medium in a concentration greater than about 0.05%. The preferred concentration is about 0.2%. The present inventors anticipate that it is technically feasible that zircoaluminate concentrations of up to 100% will be effective in the present invention.

The pH of the aqueous solution of the zircoaluminate compound can be adjusted to improve effectiveness as a rinse aid enhancer. The processes are most effective at pH's ranging from about 5 to about 10. The preferred pH range is from 7 to 9.

The process of applying the aqueous solution of the zircoaluminate compound may be either by spraying the plastic part or by immersing the plastic part in the aqueous solution. However applied, sufficient contact time must be allowed for the zircoaluminate compound - plastic reaction to occur to provide for sufficient rinseability.

The zircoaluminate compound aqueous solution may also be employed alone with other wetting agents. They may improve the wettability and reactivity of the zircoaluminate compounds. The present inventors anticipate that any surfactant that lowers the surface tension of the water on the plastic will prove useful. Modified oxyethylated straight chain alcohols are relevant examples of these surfactants.

The invention will now be further described with reference to a number of specific examples which are to be regarded solely as illustrative, and not as restricting the scope of the invention.

EXAMPLES

Automotive grade plastic parts (trade names Xenoy and Pulse, available from General Electric) were processed according to the following sequence:

| Stage | Treatment Step |
|---|---|
| 1 | 3% Betz Kleen® 132 alkaline wash, 1 minute spray at 140° F. |
| 2 | Tap water rinse, 45 seconds |
| 3 | 2% Permatreat® 302 acidic wash, 30 second spray at 135° F. |
| 4 | Tap water rinse, 30 seconds |
| 5 | Deionized water rinse, 30 seconds |
| 6 | Deionized water rinse, 10 seconds |

Betz Kleen® 132 and Permatreate®302 are both available from Betz Laboratories, Inc., Trevose, Pa.

To evaluate the efficacy of the inventive treatment as a rinse aid, dilute deionized water solutions (0.2% v/v) of zircoaluminate compounds were used in place of the deionized water rinse in stage 5.

For a material to be effective as a reactive rinse aid, a subsequent deionized water rinse (stage 6) will wet out on the surface. In the absence of a reactive rinse aid, the deionized water rinse will form beads on a plastic surface and would be given a rating of 0% in our testing. A rating of 100% indicates that the deionized water rinse completely wets the surface. Testing was performed at several pH values. These results are reported in Tables I and II.

TABLE I

Percent wetting of a final (Stage 6) Deionized Water Rinse Xenoy Plastic

| Treatment Agent | pH = 4.0 ± 0.5 | pH = 7.0 | pH = 8.0 |
|---|---|---|---|
| Deionized Water | | 0%/0%* | |
| Manchem® APG X | 0%/0% | 25%/75% | 100%/100% |
| Manchem® F | 0%/0% | 25%/25% | 100%/100% |
| Manchem® S | 0%/0% | 100%/100% | 100%/100% |
| Manchem® APG 1 | 0%/0% | 0%/0% | 25%/25% |
| Manchem® APG 3 | 0%/25% | 75%/100% | 100%/100% |

*Indicates duplicate panels

TABLE II

Percent wetting of a final (Stage 6) Deionized Water Rinse Pulse Plastic

| Treatment Agent | pH = 4.0 ± 0.5 | pH = 7.0 | pH = 8.0 |
|---|---|---|---|
| Deionized Water | | 0%/0%* | |
| Manchem® F | 0%/0% | 50%/25% | 25%/25% |
| Manchem® S | 50%/50% | 100%/90% | 0%/0% |
| Manchem® APG 1 | 0%/0% | 0%/0% | 0%/0% |
| Manchem® APG 3 | 0%/0% | 100%/100% | 50%/50% |

*Indicates duplicate panels

The results as reported in Tables I and II are indicative that the zircoaluminate compounds in aqueous solution react with the plastic and provide a rinse aid in subsequent rinses. These results are further indicative of the effect of solution pH on the efficacy of the zircoaluminate compounds.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A process for enhancing the drainage of residual aqueous rinse for the external surfaces of plastic parts comprising contacting said plastic parts with an effective amount of an aqueous solution of a ziroaluminate compound, for the purpose of enhancing said the drainage of residual aqueous rinse wherein said compound remains on the surfaces of said parts during subsequent rinse stages.

2. The process as claimed in claim 1 wherein said zircoaluminate compound has the formula

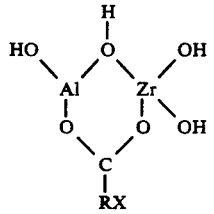

wherein RX can be $NH_2(CH_2)_2$, $(CH_2(_4COOH$, $(CH_2)_{12}CH_3$, $SH(CH_2)_2$, $CH(NH_2)CH_2OH$ and $(NH_2)CHCH_2SH$.

3. The process as claimed in claim 1 wherein the concentration of said zircoaluminate compound in said aqueous solution is greater than about 0.05% by weight.

4. The process as claimed in claim 3 wherein the concentration of said zircoaluminate compound in said aqueous solution is about 0.2% by weight.

5. The process as claimed in claim 1 wherein the pH of the aqueous solution is about 5 to about 10.

6. The process as claimed in claim 5 wherein the pH of the aqueous solution is from 7 to 9.

7. The process as claimed in claim 1 wherein said contacting is by spraying said aqueous solution.

8. The process as claimed in claim 1 wherein said contacting is by immersing said plastic parts in said aqueous solution.

* * * * *